US009081362B2

(12) United States Patent
Yoon et al.

(10) Patent No.: US 9,081,362 B2
(45) Date of Patent: Jul. 14, 2015

(54) IMAGE FORMING APPARATUS INCLUDING A FAN-MOTOR UNIT TO PREVENT CONTAMINATION OF A CHARGING UNIT

(71) Applicant: SAMSUNG ELECTRONICS CO., LTD., Suwon-si, Gyeonggi-do (KR)

(72) Inventors: Hwan Jin Yoon, Suwon-si (KR); Il Kwon Kang, Suwon-si (KR); Mi Hyun Hwang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 33 days.

(21) Appl. No.: 13/718,007

(22) Filed: Dec. 18, 2012

(65) Prior Publication Data

US 2013/0164021 A1 Jun. 27, 2013

(30) Foreign Application Priority Data

Dec. 23, 2011 (KR) ..... 10-2011-0141531

(51) Int. Cl.
*G03G 21/20* (2006.01)

(52) U.S. Cl.
CPC ..... *G03G 21/206* (2013.01); *G03G 2221/1645* (2013.01)

(58) Field of Classification Search
CPC ..... G03G 21/20; G03G 21/206; G03G 221/1645; G03G 15/02582
USPC ..... 399/92, 93
See application file for complete search history.

(56) References Cited

U.S. PATENT DOCUMENTS

| | | | | |
|---|---|---|---|---|
| 4,178,092 | A * | 12/1979 | Yamamoto et al. | 399/93 |
| 2006/0045558 | A1* | 3/2006 | Nishida et al. | 399/93 |
| 2010/0158558 | A1 | 6/2010 | Hano | |
| 2011/0222897 | A1 | 9/2011 | Makino | |

FOREIGN PATENT DOCUMENTS

JP 61-201265 9/1986

OTHER PUBLICATIONS

Extended European Search Report dated Jul. 14, 2014 from European Patent Application No. 12198738.2, 5 pages.

* cited by examiner

*Primary Examiner* — Hoang Ngo
(74) *Attorney, Agent, or Firm* — Staas & Halsey LLP

(57) ABSTRACT

An image forming apparatus has a structure which prevents contamination of charging units charging photoconductors. The image forming apparatus includes photoconductor units, charging units charging the photoconductor units, and a fan-motor unit changing the flow of air between the photoconductor units and the charging units to prevent substances of fine particles from flowing into the charging units.

20 Claims, 4 Drawing Sheets

IMAGE FORMING APPARATUS INCLUDING A FAN-MOTOR UNIT TO PREVENT CONTAMINATION OF A CHARGING UNIT

CROSS-REFERENCE TO RELATED APPLICATIONS

This application claims the priority benefit of Korean Patent Application No. 10-2011-0141531, filed on Dec. 23, 2011 in the Korean Intellectual Property Office, the disclosure of which is incorporated herein by reference.

BACKGROUND

1. Field

Embodiments disclosed herein relate to an image forming apparatus having a structure which prevents contamination of charging units charging photoconductors forming images.

2. Description of the Related Art

Image forming apparatuses form an image on a printing medium according to an input signal, may include a printer, a copying machine, a scanner, a facsimile and a multi-function apparatus combining functions of two or more of a printer, a copying machine, a scanner or a facsimile.

An electrophotographic image forming apparatus which is a kind of image forming apparatus includes a developing device including photoconductors, charging units and developing units, and a light scanning unit. The light scanning unit irradiates light to the photoconductors charged with designated potential by the charging units to form electrostatic latent images on the surfaces of the photoconductors, and developing units supply developers to the photoconductors on which the electrostatic latent images are formed to form visible images.

There are various charging methods to charge photoconductors. Among the various charging methods, one method includes charging the surfaces of photoconductors using corona discharge, in which a charge potential of the photoconductors may be stabilized by controlling charge current by grid bias applied to a grid. However, various discharge oxides, such as ozone and nitrogen oxides, may be generated by the discharge according to a strong charge current. Therefore, a separate device to remove the discharge oxides harmful to human health is required. Dust having fine particles and toner around the charging units and the photoconductors may be sucked together with the discharge oxides during a process of sucking air including the discharge oxides to remove the discharge oxides. This may result in contaminating the charging units, and cause degradation of image quality.

SUMMARY

Therefore, it is an aspect of the present invention to provide an image forming apparatus having an improved structure which prevents contamination of charging units charging photoconductors to thereby improve or at least maintain image quality.

Additional aspects of the invention will be set forth in part in the description which follows and, in part, will be obvious from the description, or may be learned by practice of the invention.

In accordance with one aspect of the present invention, an image forming apparatus includes photoconductor units, charging units charging the photoconductor units, and a fan-motor unit changing flow of air between the photoconductor units and the charging units to prevent substances of fine particles from flowing into the charging units.

The image forming apparatus may further include a light scanning unit irradiating light to the photoconductor units, and the fan-motor unit may be disposed between the light scanning unit and the photoconductor units.

The fan-motor unit may change the flow of air on a path of light irradiated from the light scanning unit.

The fan-motor unit may include a fan motor forming a flow of air and a guide member guiding the flow of air formed by the fan motor to gaps between the photoconductor units and the charging units.

The image forming apparatus may further include a light scanning unit irradiating light to the photoconductor units, and the fan-motor unit may be disposed below the light scanning unit.

The image forming apparatus may further include a suction unit disposed in the rear of the charging units which sucks oxides generated from the charging units during a process of charging the photoconductor units, and the fan-motor unit may be disposed below the suction unit and form a flow of air in a direction opposite to a flow of air formed by the suction unit so as to prevent the substances of fine particles from flowing into the charging units by the suction unit.

The fan-motor unit may be driven together with the suction unit.

The image forming apparatus may further include a first channel in which air sucked by the suction unit flows and a second channel in which air discharged by the fan-motor unit flows, and the first channel and the second channel may be divided so as not to communicate with each other.

The suction unit may include a suction housing forming the first channel, and the first channel and the second channel may be divided by the lower end of the suction housing.

The fan-motor unit may include a fan motor forming a flow of air and a guide member guiding the flow of air formed by the fan motor to gaps between the photoconductor units and the charging units. The guide member may face the lower end of the suction housing, and air discharged through the guide member may collide with the lower end of the suction housing and be dispersed in the lengthwise direction of the photoconductor units and the charging units.

In accordance with another aspect of the present invention, an image forming apparatus includes a main body, a developing device disposed within the main body, and including photoconductor units bearing images, developing units supplying developers to the photoconductor units, and charging units charging the photoconductor units, a suction unit disposed in the rear of the developing device and sucking oxides generated from the charging units, and a fan-motor unit disposed around the developing device and discharging air toward the photoconductor units so as to prevent substances of fine particles from flowing into the charging units by the suction unit.

The fan-motor unit may be disposed below the suction unit.

The suction unit may include a suction housing, and a first channel formed within the suction housing such that air sucked by the suction unit flows in the first channel.

The image forming apparatus may further include a second channel divided from the first channel and formed below the first channel such that air discharged by the fan-motor unit flows in the second channel.

The second channel may be communicated with gaps between the photoconductor units and the charging units.

The fan-motor unit may include a fan motor forming a flow of air, and a guide member guiding the flow of air formed by the fan motor to the lower end of the suction housing.

The image forming apparatus may further include a light scanning unit irradiating light to the photoconductor units, and the fan-motor unit may be disposed below the light scanning unit and discharge air on a path of light irradiated by the light scanning unit.

The developing device may further include a space part forming a part of the path of light irradiated by the light scanning unit and communicated with gaps between the photoconductor units and the charging units, and the fan-motor unit may discharge air toward the space part.

The fan-motor unit may be driven together with the suction unit.

In accordance with another aspect of the present invention, an image forming apparatus includes at least one charging unit to charge at least one photoconductor unit, a suction unit disposed adjacent to the at least one charging unit to draw in oxides generated by the at least one charging unit by generating a sucking force in a first direction, and a fan-motor unit disposed below the suction unit to discharge air in a second direction, opposite of the first direction, to prevent substances from flowing into the at least one charging unit due to the sucking force of the suction unit.

The suction unit may include a suction housing having a lower end separating the suction unit from the fan-motor unit, and air discharged by the fan motor unit collides with the lower end of the suction housing. The image forming apparatus may include a channel formed below the suction housing of the suction unit, at least one gap formed between the at least one photoconductor unit and the at least one charging unit, and a space part formed between the channel and the at least one gap, wherein air discharged by the fan motor unit flows from the channel into the space part.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
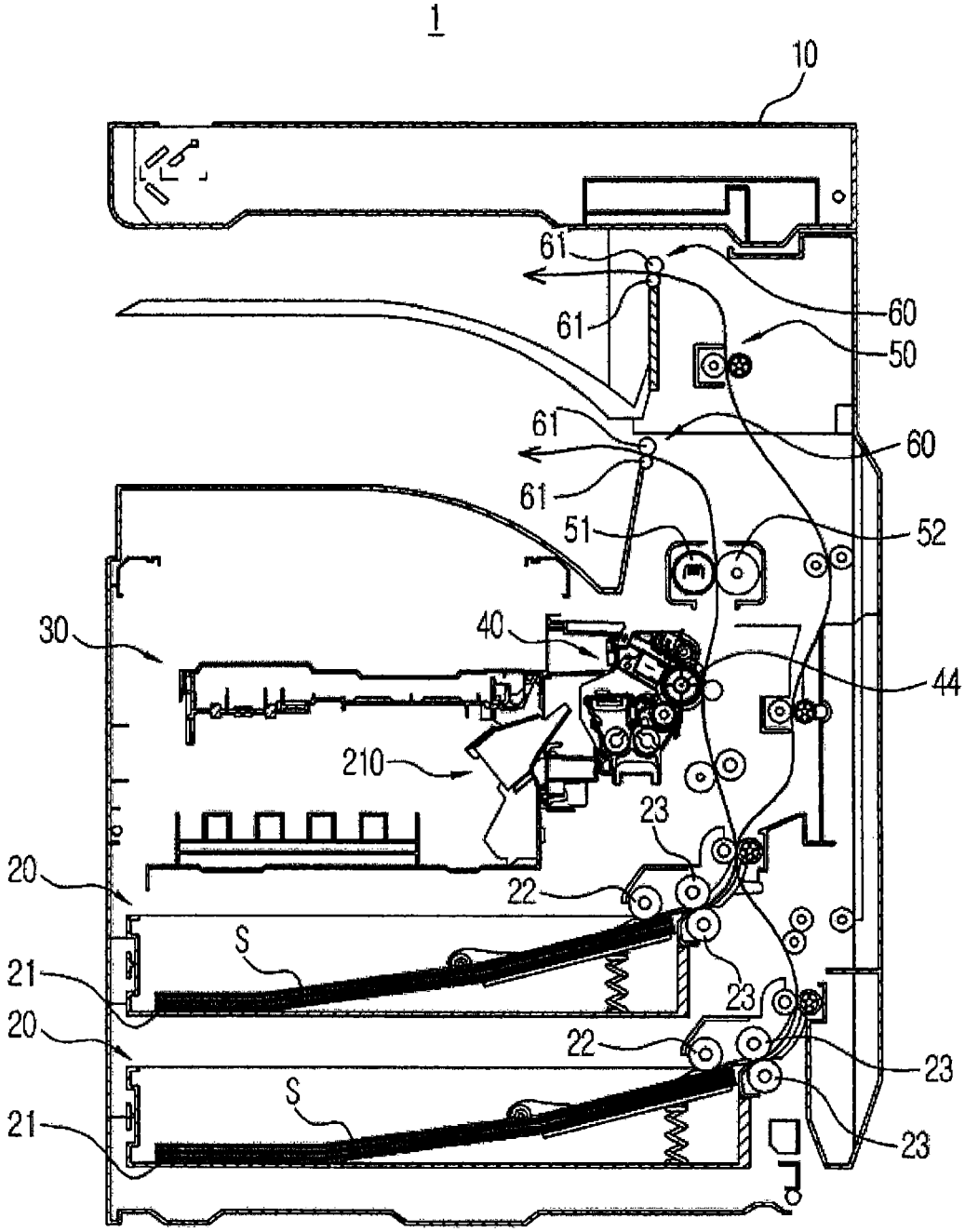
FIG. 1 is a view schematically illustrating the configuration of an image forming apparatus in accordance with one embodiment of the present invention.

Reference will now be made in detail to the embodiments of the present invention, examples of which are illustrated in the accompanying drawings, wherein like reference numerals refer to like elements throughout.

FIG. 1 is a view schematically illustrating an example configuration of an image forming apparatus in accordance with one embodiment of the present invention.

As shown in FIG. 1, an image forming apparatus 1 includes a main body 10, printing medium supply (i.e., feeding) units 20, a light scanning unit 30, a developing device 40, a fixing unit 50, and a printing medium exit (i.e., discharge) unit 60.

The main body 10 forms the external appearance of the image forming apparatus 1, and supports various parts installed therein.

The image forming apparatus 1 may include one or more printing medium supply units 20. Although there are two printing medium supply units shown in FIG. 1, there may be more or less than two printing medium supply units. The printing medium supply unit 20 includes a cassette 21 in which printing media S are stored, a pickup roller 22 picking the printing media S stored in the cassette 21 sheet by sheet, and feed rollers 23 to feed the picked-up printing media S to the developing device 40. The printing medium S used by the image forming apparatus 1 may include printing paper sheets such as glossy paper, plain paper, art paper, overhead projector film, and the like.

The light scanning unit 30 may be disposed in the rear of the developing device 40, and irradiates light corresponding to image information to photoconductors 44 to form electrostatic latent images on the surfaces of the photoconductors 44.

The fixing unit 50 may include a heating roller 51 provided with a heat source, and a pressing roller 52 installed opposite the heating roller 51. When a printing medium passes through a space between the heating roller 51 and the pressing roller 52, an image is fixed to the printing medium by heat transmitted from the heating roller 51 and pressure generated between the heating roller 51 and the pressing roller 52. The heat source may include, for example, a heat lamp (e.g., halogen lamp), heating coil, a resistive heating element, or other heating device.

The printing medium exit unit 60 may include a plurality of exit rollers 61, and discharges the printing medium having passed through the fixing unit 50 to the outside of the main body 10.

Figure 2:
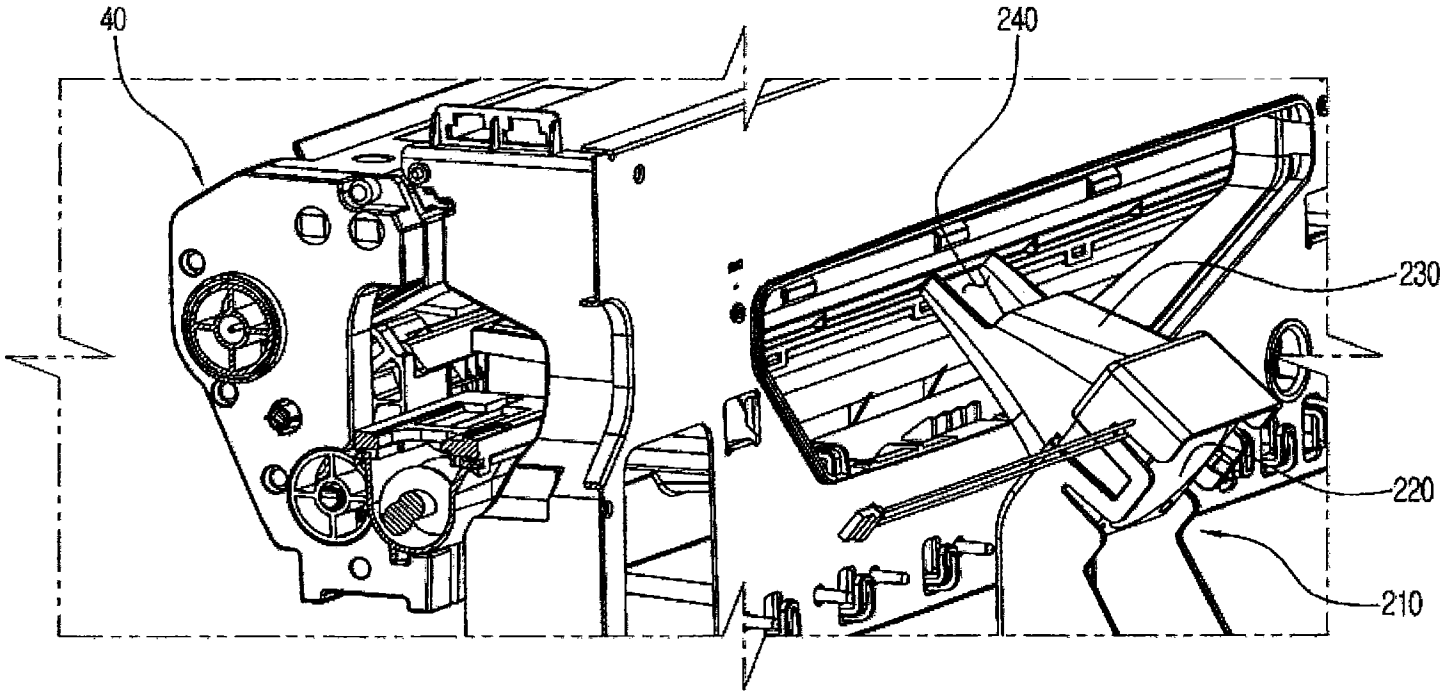
FIG. 2 is an extracted perspective view illustrating the configuration of the image forming apparatus in accordance with the embodiment of the present invention around a fan-motor unit and a developing device.
Figure 3:
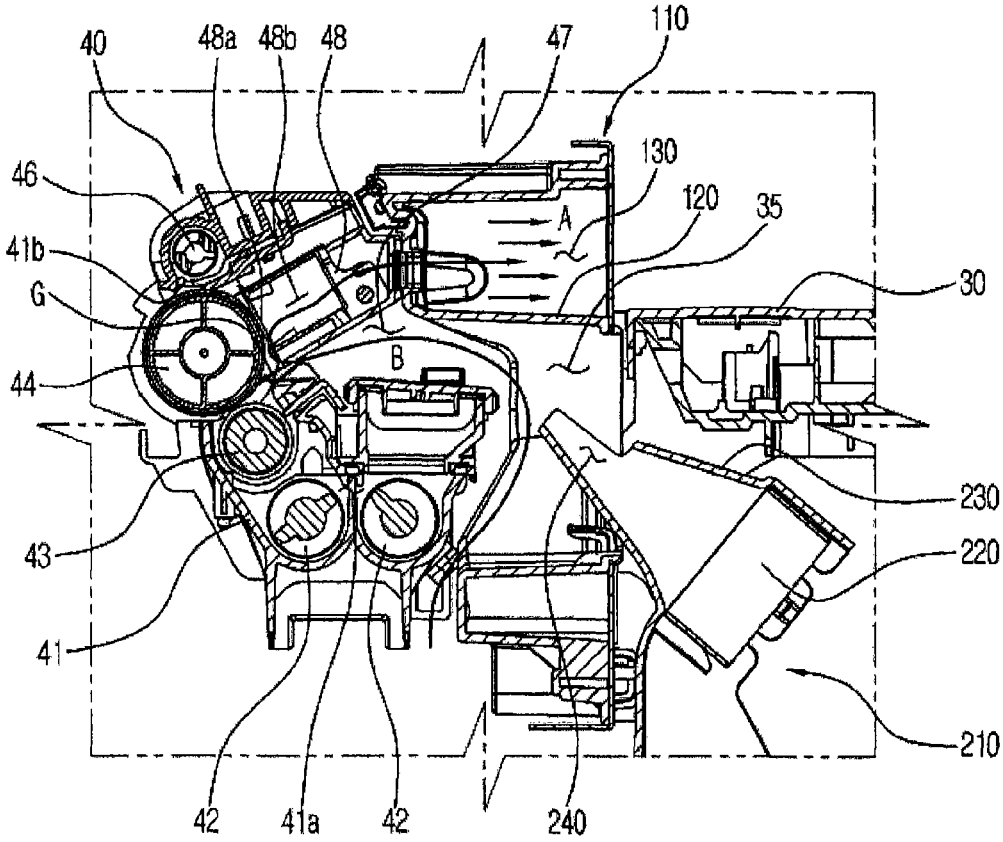
FIG. 3 is a cross-sectional view taken along the line I-I of FIG. 2, illustrating flow of air around the developing device when the fan-motor unit is not driven.

FIG. 2 is an extracted perspective view illustrating the configuration of the image forming apparatus in accordance with an embodiment of the present invention around a fan-motor unit and the developing device. FIG. 3 is a cross-sectional view taken along the line I-I of FIG. 2, illustrating flow of air around the developing device when the fan-motor unit is not driven, and FIG. 4 is a cross-sectional view taken along the line I-I of FIG. 2, illustrating flow of air around the developing device when the fan-motor unit is driven.

Figure 4:
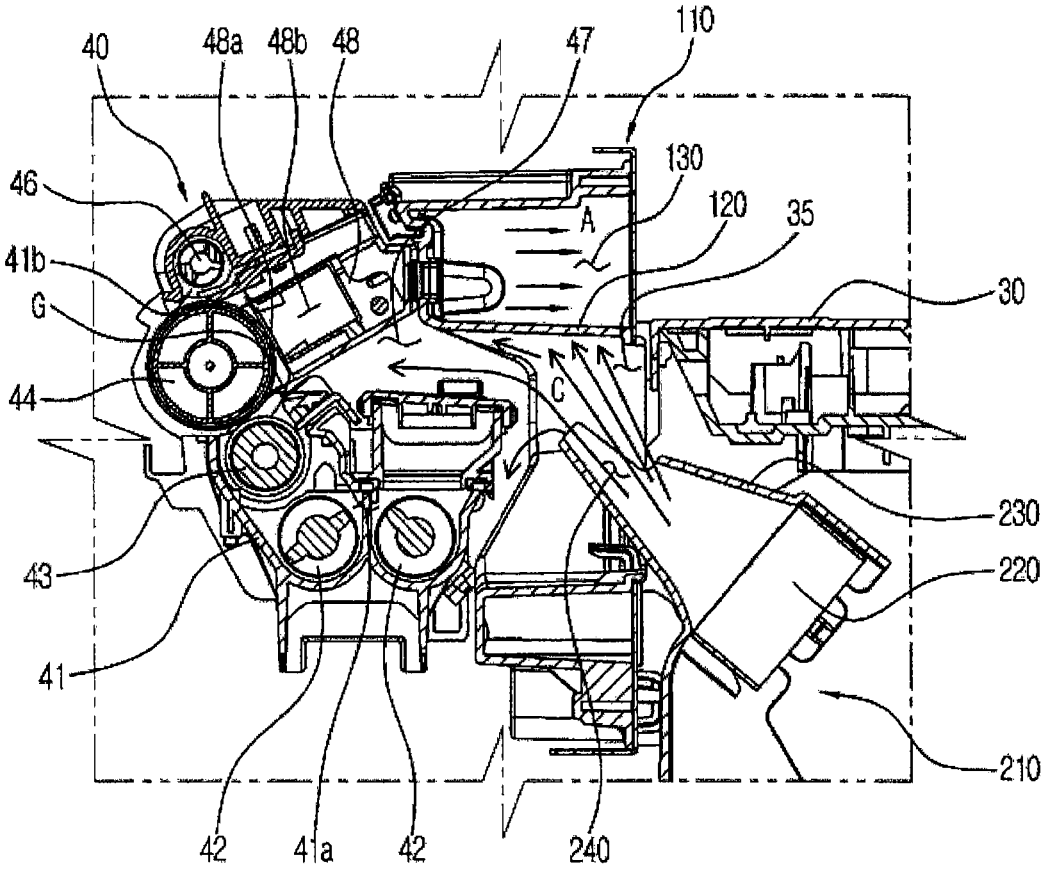
FIG. 4 is a cross-sectional view taken along the line I-I of FIG. 2, illustrating flow of air around the developing device when the fan-motor unit is driven.

As shown in FIGS. 2 to 4, the developing device 40 may include photoconductors 44 provided with surfaces on which electrostatic latent images are formed by developers supplied from developing rollers 43 and light irradiated from the light scanning unit 30, the developing rollers 43 supplying the developers to form electrostatic latent images on the surfaces of the photoconductors 44, and charging units 48 charging the surfaces of the photoconductors 44 with a designated potential.

Further, the developing device 40 may include a developing device case 41 forming the external appearance of the developing device 40, developer receiving chambers 41*a* provided within the developing device case 41 and storing the developers, waste developer receiving chambers 41*b* storing waste developers, a pair of developer agitators 42 disposed within the developer receiving chamber 41*a* and agitating and feeding the developers, and a waste developer agitator 46 disposed within the waste developer receiving chamber 41*b* and agitating the waste developer.

The developer received in the developer receiving chamber 41*a* is agitated by the pair of developer agitators 42 and is fed to the developing roller 43 during the agitation process using the pair of developer agitators 42, and the developing roller 43 supplies the fed developer to the photoconductor 44 charged with the designated potential to form a visible image.

The charging unit 48 includes a first electrode 48*a* disposed opposite the photoconductor 44, and a second electrode 48*b* separated from the first electrode 48*a*. The first electrode 48*a* employs a grid-shaped electrode, the second electrode 48*b* employs a wire-shaped electrode provided with the front end extending toward the first electrode 48*a*, and corona discharge is generated between the first electrode 48*a* and the second electrode 48*b*. Here, the first electrode 48*a* and the second electrode 48*b* may be electrically connected, or different voltages may be applied to the first electrode 48*a* and the second electrode 48*b*.

When high current flows on the first electrode 48*a* and corona discharge is generated, components in air around the discharge unit 48 and the photoconductor 44 are activated and thus discharge oxides are generated. Since the generated discharge oxides include components harmful to human health, such as ozone (O3) and nitrogen oxides (NOx), a suction unit 110 to suck the discharge oxides generated during the charging process of the photoconductors 44 is connected to the charging units 48.

The suction unit 110 communicates with the charging units 48, and includes a first channel 130 in which sucked air and discharge oxides flow, a suction housing 120 forming the first channel 130, and a power source (not shown) generating suction force. The discharge oxides sucked by the suction unit 110 are collected in a designated space within the main body 10 of the image forming apparatus 1, and are then discharged to the outside of the image forming apparatus 1 via a separate process.

A fan-motor unit 210 prevents suction of dust of fine particles, toner, etc. around the charging units 48 or the photoconductors 44 from being sucked together with the discharge oxides through gaps G between the photoconductors 44 and the charging units 48. This prevents contamination of the charging units 48 by the dust and toner during a process of sucking air containing the discharge oxides by the suction unit 110. The fan-motor unit 210 may be disposed below the suction unit 110 between the light scanning unit 30 and the photoconductors 44.

The fan-motor unit 210 may include a fan motor 220 which generates power to form flow of air in a designated direction (e.g., direction C as shown in FIG. 4), a guide member 230 to guide the flow of air formed by the fan motor 220 to the lower end of the suction housing 120, and an air discharge hole 240 formed by opening one end of the guide member 230 so as to discharge air guided by the guide member 230.

A second channel 35 in which air discharged by the fan-motor unit 210 flows is provided below the suction housing 120. The second channel 35 communicates with a space part 47 provided on the rear surface of the developing device 40, and the second channel 35 and the space part 47 forms a path of light, through which light irradiated from the light scanning unit 30 may reach the photoconductors 44.

Air discharged to the lower end of the suction housing 120 by the fan-motor unit 210 collides with the lower end of the suction housing 120, is uniformly dispersed in the lengthwise direction of the suction housing 120, moves in the direction almost opposite to the flow of air formed by the suction unit 110, flows in the second channel 35 and the space part 47, and blows substances, such as various dust of fine particles and toner having a possibility of flowing into the gaps G between the photoconductors 44 and the charging units 48 during the suction process, in the direction opposite to the suction direction of the suction unit 110.

Since the first channel 130 and the second channel 35 are divided from each other by the lower end surface of the suction housing 120, the flow of air formed in the first channel 130 by the suction unit 110 and the flow of air formed in the second channel 35 by the fan-motor unit 210 are not mixed. That is, as can be seen from FIG. 4, air discharged from the fan-motor unit 210 moves in a direction as shown by arrow C, which is opposite to the flow of air, as shown by arrow A, formed by the suction unit 110. The airflow C does not mix with the airflow A due to the separation of the first channel 130 and the second channel 35 formed by the bottom surface of the suction housing 120.

FIG. 3 illustrates flow of air if the suction unit 110 alone is operated, and FIG. 4 illustrates flow of air if both the suction unit 110 and the fan-motor unit 210 are simultaneously operated.

If the suction unit 110 alone is operated, air around the photoconductors 44 and the charging units 48 flows in the direction toward the charging units 48, as shown by arrow B, through the gaps G between the photoconductors 44 and the charging units 48 by suction force of the suction unit 110, and during such a process, dust of fine particles and toner around the charging units 48 and the photoconductors 44 flow into the charging units 48 via the flow of air and may contaminate the first electrodes 48*a*, for example. Other structures may also become contaminated by particles or debris which are sucked into the gaps G due to the suction force of the suction unit 110.

When the fan-motor unit 210 is operated together with operation of the suction unit 110, as shown in FIG. 4, air discharged from the fan-motor unit 210 moves in the direction, as shown by arrow C, opposite to the flow of air, as shown by arrow A, formed by the suction unit 110 along the second channel 35 and the space part 47, and prevents dust of fine particles and toner around the charging units 48 and the photoconductors 44 from flowing into the charging units 48 through the gaps G between the photoconductors 44 and the charging units 48.

Since suction force of the suction unit 110 is directly applied to the insides of the charging units 48 and the first channel 130 and discharge force of the fan-motor unit 210 is directly applied to the second channel 35 and the space part 47 directly communicated with the gaps G between the photoconductors 44 and the charging units 48, when the fan-motor unit 210 is operated, dust of fine particles and toner around the charging units 48 and the photoconductors 44 do not flow into the charging units 48 through the gaps G between the photoconductors 44 and the charging units 48. For example, as can be seen from FIG. 3, when the fan motor unit 210 is not operated, particles and debris may be sucked in through the gaps G along the flow of air shown by arrow B. However, when the fan motor unit 210 is operated simultaneously with the suction unit 110, as shown in FIG. 4, the airflow of arrow B and corresponding suction force caused by the suction unit 110 is counteracted by the discharge of air caused by fan motor unit 210, thereby preventing particles and debris from being sucked in through gaps G. For example, the discharge force of the fan-motor unit 210 causes air to flow into the space part 47 which is disposed below the charging unit 48, in a direction opposite to the airflow caused by the suction force of the suction unit 110 in the first channel 130. Additionally, the discharge force of the fan-motor unit 210 cause air to flow in a downward vertical direction in a space part between the developer receiving chamber 41*a* and the fan motor unit 210.

As is apparent from the above description, in an image forming apparatus in accordance with one embodiment of the present invention, a fan-motor unit prevents suction of dust of fine particles and toner around charging units and photoconductor units from being sucked together with discharge oxides which are sucked into a suction unit. Therefore, the charging units may stably charge the photoconductor units for a long time without contamination of the charging units.

The image forming apparatus may use one or more processors, which may include a microprocessor, central processing unit (CPU), digital signal processor (DSP), or application-specific integrated circuit (ASIC), as well as portions or combinations of these and other processing devices, to perform various functions of the image forming apparatus, fan motor unit, and/or suction unit, according to the above-described example embodiments.

One of ordinary skill in the art would understand that the above-disclosed image forming apparatus may include a printer, a copy machine, a scanner, a facsimile, and a multifunctional device which incorporates two or more of the functionalities of the printer, the copy machine, the scanner, and the facsimile (which may be referred to as a multifunctional peripheral device or MFP). Additionally, the printer may have the capability for single-sided printing and/or duplex printing, and is not limited to the example embodiment of the printer shown in FIG. 1. Further, the printer may have one or more developing devices, and may include only a single developing device with a single color, or may include developing devices having a plurality of colors (e.g., yellow, magenta, cyan, black, orange, green, blue, red, etc.).

Although a few example embodiments of the present invention have been shown and described, it would be appreciated by those skilled in the art that changes may be made to these embodiments without departing from the principles and spirit of the invention, the scope of which is defined in the claims and their equivalents.

What is claimed is:

1. An image forming apparatus comprising:

at least one photoconductor unit;

at least one charging unit to charge the at least one photoconductor unit;

a suction unit disposed in the rear of the at least one charging unit to suck substances generated from the at least one charging unit; and a fan-motor unit to discharge air toward an outside surface of the suction unit and to change a flow of air outside of the at least one photoconductor unit and the at least one charging unit to prevent substances from flowing into the at least one charging unit, wherein the fan-motor unit is disposed below the suction unit and forms a flow of air in a direction opposite to a flow of air formed by the suction unit to prevent the substances from flowing into the at least one charging unit by the suction unit.

2. The image forming apparatus according to claim 1, further comprising a light scanning unit to irradiate light to the at least one photoconductor unit, wherein the fan-motor unit is disposed between the light scanning unit and the at least one photoconductor unit.

3. The image forming apparatus according to claim 2, wherein the fan-motor unit changes flow of air on a path of light irradiated from the light scanning unit.

4. The image forming apparatus according to claim 1, wherein the fan-motor unit includes:

a fan motor to form a flow of air; and a guide member to guide the flow of air formed by the fan motor to gaps between the at least one photoconductor unit and the at least one charging unit.

5. The image forming apparatus according to claim 1, further comprising a light scanning unit irradiating light to the photoconductor units, wherein the fan-motor unit is disposed below the light scanning unit.

6. The image forming apparatus according to claim 1, wherein the fan-motor unit is driven together with the suction unit.

7. The image forming apparatus according to claim 1, further comprising a first channel in which air sucked by the suction unit flows and a second channel in which air discharged by the fan-motor unit flows, wherein the first channel and the second channel are divided so as not to communicate with each other.

8. The image forming apparatus according to claim 7, wherein:

the suction unit includes a suction housing forming the first channel; and the first channel and the second channel are divided by a lower end of the suction housing.

9. The image forming apparatus according to claim 8, wherein:

the fan-motor unit includes a fan motor to form a flow of air, and a guide member to guide the flow of air formed by the fan motor to gaps between the at least one photoconductor unit and the at least one charging unit, wherein the guide member faces the lower end of the suction housing, and air discharged through the guide member collides with the lower end of the suction housing and is dispersed in a lengthwise direction of the at least one photoconductor unit and the at least one charging unit.

10. An image forming apparatus comprising:

a main body;

a developing device disposed within the main body, and including at least one photoconductor unit to form at least one image, at least one developing unit to supply developer to the at least one photoconductor unit, and at least one charging unit to charge the at least one photoconductor unit;

a suction unit disposed in the rear of the at least one charging unit to suck oxides generated from the at least one charging unit; and a fan-motor unit spaced apart from the at least one charging unit to discharge air toward an outside surface of the suction unit to prevent substances from flowing into the at least one charging unit due to the sucking of the suction unit, wherein the fan-motor unit is disposed below the suction unit.

11. The image forming apparatus according to claim 10, wherein the suction unit includes:

a suction housing; and a first channel formed within the suction housing such that air sucked by the suction unit flows in the first channel.

12. The image forming apparatus according to claim 11, further comprising a second channel divided from the first channel and formed below the first channel such that air discharged by the fan-motor unit flows in the second channel.

13. The image forming apparatus according to claim 12, wherein the second channel communicates with at least one between the at least one photoconductor unit and the at least one charging unit.

14. The image forming apparatus according to claim 13, wherein the fan-motor unit includes:

a fan motor to form a flow of air; and a guide member to guide the flow of air formed by the fan motor to a lower end of the suction housing.

15. The image forming apparatus according to claim 10, further comprising a light scanning unit to irradiate light to the at least one photoconductor unit, wherein the fan-motor unit is disposed below the light scanning unit and discharges air on a path of light irradiated by the light scanning unit.

16. The image forming apparatus according to claim 15, wherein:

the developing device further includes a space part forming a part of the path of light irradiated by the light scanning unit which communicates with gaps between the at least one photoconductor unit and the at least one charging unit, wherein the fan-motor unit discharges air toward the space part.

17. The image forming apparatus according to claim 10, wherein the fan-motor unit is driven together with the suction unit.

18. An image forming apparatus comprising:

at least one charging unit to charge at least one photoconductor unit;

a suction unit disposed adjacent to the at least one charging unit to draw in oxides generated by the at least one charging unit by generating a sucking force in a first direction; and a fan-motor unit disposed below the suction unit to discharge air in a second direction, opposite of the first direction, to prevent substances from flowing into the at least one charging unit due to the sucking force of the suction unit, wherein the fan-motor unit includes a fan motor to form a flow of air, and a guide member spaced apart from the at least one charging unit to guide the flow of air formed by the fan motor toward an outside surface of the suction unit.

19. The image forming apparatus according to claim 18, wherein the suction unit includes a suction housing having a lower end separating the suction unit from the fan-motor unit, and air discharged by the fan motor unit collides with the lower end of the suction housing.

20. The image forming apparatus according to claim 18, further comprising:

a channel formed below a suction housing of the suction unit;

at least one gap formed between the at least one photoconductor unit and the at least one charging unit; and a space part formed between the channel and the at least one gap, wherein air discharged by the fan motor unit flows from the channel into the space part.

* * * * *